US009623465B1

(12) United States Patent
Bergstrom

(10) Patent No.: US 9,623,465 B1
(45) Date of Patent: Apr. 18, 2017

(54) MANUALLY OPERATED ROD STOCK BENDING DEVICE

(71) Applicant: Kenneth L. Bergstrom, Carmichael, CA (US)

(72) Inventor: Kenneth L. Bergstrom, Carmichael, CA (US)

( * ) Notice: Subject to any disclaimer, the term of this patent is extended or adjusted under 35 U.S.C. 154(b) by 0 days.

(21) Appl. No.: 15/044,737

(22) Filed: Feb. 16, 2016

(51) Int. Cl.

| | |
|---|---|
| ***B21J 13/08*** | (2006.01) |
| ***B21D 7/02*** | (2006.01) |
| ***B21F 1/06*** | (2006.01) |
| ***B21D 7/024*** | (2006.01) |
| ***B21F 11/00*** | (2006.01) |
| ***B21D 7/00*** | (2006.01) |
| ***B21D 7/06*** | (2006.01) |
| ***E04G 17/18*** | (2006.01) |

(52) U.S. Cl.
CPC ..... *B21D 7/02* (2013.01); *B21D 7/00* (2013.01); *B21D 7/024* (2013.01); *B21D 7/063* (2013.01); *B21F 1/06* (2013.01); *B21F 11/00* (2013.01); *E04G 17/18* (2013.01)

(58) Field of Classification Search
CPC ..... B21D 7/00; B21D 7/024; B21D 7/063; B21D 7/02; B21F 1/06; B21F 11/00; E04G 17/18
USPC ..... 72/458, 388, 217
See application file for complete search history.

(56) References Cited

U.S. PATENT DOCUMENTS

| | | | | |
|---|---|---|---|---|
| 2,053,309 A * | 9/1936 | Yeager | B21F 11/00 | 29/564 |
| 2,535,346 A * | 12/1950 | Fredwill | E04G 17/18 | 249/48 |
| 2,675,723 A * | 4/1954 | Stein | B21D 7/063 | 72/458 |
| 2,857,792 A * | 10/1958 | McNish | B21F 1/06 | 140/123 |
| 3,732,721 A * | 5/1973 | Cusimano | B21D 7/024 | 72/217 |
| 6,418,773 B1 * | 7/2002 | Tolman | B21D 7/024 | 72/218 |
| 7,673,492 B2 * | 3/2010 | Hough | B21D 7/00 | 72/218 |

* cited by examiner

*Primary Examiner* — David B Jones
(74) *Attorney, Agent, or Firm* — John L Sotomayor

(57) ABSTRACT

This document presents a system and method for presenting the invention as a tool that provides the ability to bend and shape rebar type material with less stress on the human body aiding in preventing common injuries that occur from standard rebar tools and processes and it provides portability so that all work can be done at the job site saving time and money from having to go to a workshop to fabricate unique shaped rebar parts.

8 Claims, 7 Drawing Sheets

MANUALLY OPERATED ROD STOCK BENDING DEVICE

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

Concrete construction is enhanced by the insertion of metal rods such as rebar to improve compression and tension characteristics of the concrete structure. To accommodate joins, curves, and other structural elements, rebar must be shaped prior to installation to support the structural components of the concrete structure. Many rebar structural pieces are shaped prior to shipping them out to a job site, if the job is big enough to permit the builder to bear the cost of ordering pre-shaped rebar. Other construction jobs are either too small to bear this cost, or the shapes required are either too complex or unknown, or the builder simply does not want to bear this cost and will bend the rebar on site to suit the needs of the construction effort.

Bending rebar for emplacement in concrete at a construction site is a common practice. Tools for bending rebar are generally makeshift or simple in nature and construction crews depend on brute force to utilize the tools for bending rebar. Bending rebar may place significant strain on the muscles in the upper and lower back, and cause damage to a construction crewman when the tool is inadequate to the job or is used improperly.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
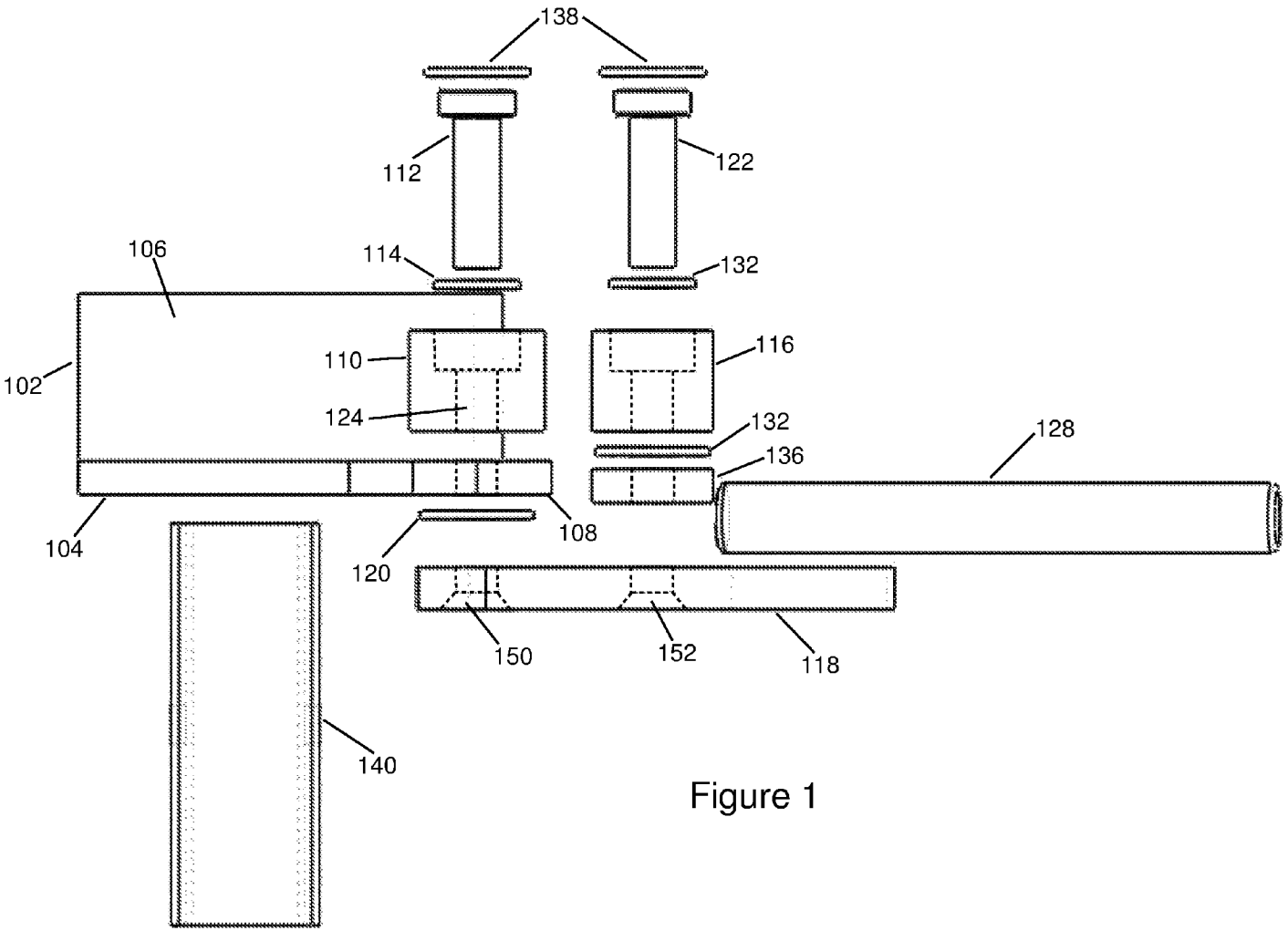
FIG. 1 is an exploded view of all individual components of a rod bending tool consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "rod bending tool" in this document refers to a tool that is used for bending concrete reinforcing rods, also known as rebar, for use in concrete construction. The rod bending tool is also suitable for bending additional reinforcing metal rods such as square stock, round stock and flat stock.

In an embodiment, the rod bending tool used for bending concrete reinforcing rods (re-bar) may be designed to perform bending tasks at a particular height and in a particular position to prevent hazards and injuries to construction crewmen that commonly occur while performing this task. The rod bending tool is a portable device that may be transported to a construction site and used as needed during construction.

Previously known Re-bar bending tools are manually operated tools placed on the ground, where the earth is used as the frame and backing for the operator to push against for bending the stock. The bending is done utilizing a user's own body weight as leverage to force the rebar to bend. Performing this task with the rebar bending tool at ground level has potential to cause a user injuries resulting from the repetitive strain of bending, stooping and pulling on the metal rod, whether the rod is rebar, square stock, round stock, flat stock, or any other type of metal or non-metal reinforcing rod. Tools for bending rebar type material designed to be fitted to a truck are also known and available. However, these tools are mounted such that the work piece is too high for a user to bend without difficulty, where there may be a lack of leverage to bend the rebar at certain necessary angles, and where the positioning of the tool may result in repetitive stress injuries to the workers.

Additionally, current and existing methods and tools lack portability. For instance it is impossible for operators to fabricate unique specialty rebar parts on site with existing tools and methods. Thus, unique specialty rebar parts, or custom shaped rebar parts suited to a unique circumstance at a job site, may have to be manufactured in a factory or specialty bending facility at additional cost. The special requirements for unique specialty rebar parts may also cause construction delays if the need is discovered during construction, or the fabricating entity requires long lead times to fulfill such orders.

The rod bending tool herein disclosed may help solve these issues by providing users a portable means to bend the material with a secure and safe positioning without requiring the human worker to use his/her body for leverage during a bending action. The rod bending tool is portable, allowing operators to fabricate unique and specialty rebar parts anywhere, such as a construction site, home site, garage or other location, rather than in the shop or factory. The rod bending tool has a specially designed frame upon which the rod bending tool may be mounted. The mounting frame may be securely attached to a vehicle. The mounting frame may provide various angles for the rod bending tool to be configured, which establishes the work space for the rod bending tool at a comfortable height above the ground level. The mounting frame also provides flexibility when attached to a workhorse or a table, creating an additional work space. The rod bending tool and mounting frame provide the leverage to bend the rebar or other metal type material, not utilizing a human body and the earth for leverage. The rod bending tool may thus help eliminate the existing problems of having insufficient leverage to perform some bends out in the field that occur with current standard tools and methods for bending rebar type material.

Additionally, the rod bending tool allows the operator to bend any type of rod stock material while standing upright without having to bend, stoop or reach excessively. This advantageous positioning may prevent injuries that commonly occur with standard existing tools and methods.

Turning now to FIG. 1, this figure presents an exploded view of a rod bending tool 100 consistent with the certain embodiments of the present invention. In an exemplary embodiment, the rod bending tool 100 may have a base plate 102 having a horizontal portion 104 and the vertical portion 106 connected together at approximately a 90 degree angle. In an alternative embodiment, the base plate 102 may be formed from a section of angle iron having the proper angle between the horizontal portion 104 and the vertical portion 106. The horizontal portion 104 may have a rounded end 108 for the connection to both a fulcrum 110 and a flat lever 118. The fulcrum 110 may be permanently mounted to the base plate 102.

In this embodiment, the base plate horizontal portion 104 may have a positioning hole 124 provided at the desired location for the fulcrum 110 to be inserted through and centered. The fulcrum 110 may be cut to fit and centered through the positioning hole 124. The fulcrum is held in position relative to the base plate 102 through the connection of a pivot shaft 112 and brass washer 114. The brass washer 114 is positioned on the pivot shaft 112 and acts as a thrust washer between pivot shaft 112 and a round roller 116.

Additionally, the pivot shaft 112 and brass washer 114 are positioned to permit free horizontal movement of the flat lever 118. To provide proper alignment and use, the pivot shaft 112 may be inserted through the positioning hole 124 cut in the fulcrum 110, and extend past the bottom surface of the horizontal portion 104 of the base plate 102.

In this exemplary embodiment, the pivot shaft 112 may be inserted through a thick brass thrust washer 120 may be positioned between the bottom surface of the horizontal portion 104 of the base plate 102 and the top surface of the flat lever 118. The brass thrust washer 120 provides for separation between the base plate 102 and the flat lever 118, and permits rotational movement of the flat lever 118 as the base plate 102 remains stationary.

A bend shaft 122 is physically connected to the flat lever 118, but is not physically connected to the base plate 102. The bend shaft 122 and pivot shaft 112 may be used in conjunction to permit more complex rotational movement than is possible with a single pivot shaft 112. The bend shaft 122 is connected to the flat lever 118 and may permit rotational movement 122 to bend rebar separate from the pivot shaft 112. The bend shaft 122 may be inserted through a brass washer 132 and into a hole drilled in the center of a round roller 116.

In this exemplary embodiment, the round roller 116 is essential in guiding the material that will be bent by the fulcrum 110. The round roller 116 is permanently attached to the top surface of the flat lever 118 by inserting and centering the bend shaft 122 through holes drilled through a brass thrust washer 132 and steel spacer 136. The holes drilled through the brass washer 132, round roller 116, brass thrust washer 132 and steel spacer 136 are each aligned to permit the bend shaft 122 to be inserted and connected to each of these portions to create the bend assembly that is attached to the flat lever 118.

The bottom ends of the pivot shaft 112 and bend shaft 122 are centered through holes (150, 152) and permanently attached to the flat bar or lever 118. The flat lever 118 is contoured on the pivot shaft 118 end and tapered at the bend shaft 122 end. The flat lever 118 is positioned below the horizontal portion 104 of the base plate 102, and provides the ability to physically manipulate the rebar stock during bending operations.

Attached parallel to the top surface of the flat lever 118 and adjacent along the same plane as the base plate 102 is a fixed round stock handle 128 which is permanently affixed to and extends past the flat lever 118. The round stock handle 128 may be rounded on both ends. The round stock handle 128 provides a grip and a longer lever arm for greater leverage for the user when performing the task of bending rebar or other rod stock material. A cap 138 is centered on top of both the fulcrum 110 and the round roller 116 to prevent foreign material dirt and debris from getting into the assembly. In non-limiting examples, the cap 138 may be substantially flat or may have a rounded top to better reduce the amount of debris that could adhere to the pivot shaft 112 and bend shaft 122.

In this exemplary embodiment, a mounting tube 140 may be attached to the bottom surface of the horizontal portion 104 of the base plate 102. The mounting tube 140 is used to attach the rod bending device directly to a post, frame, trailer hitch or vehicle, or to any additional support apparatus that may then be attached to a post, frame, vehicle, or trailer hitch. In this exemplary embodiment a standard trailer hitch pin may be used to hold the mounting adapter securely in place.

Figure 2:
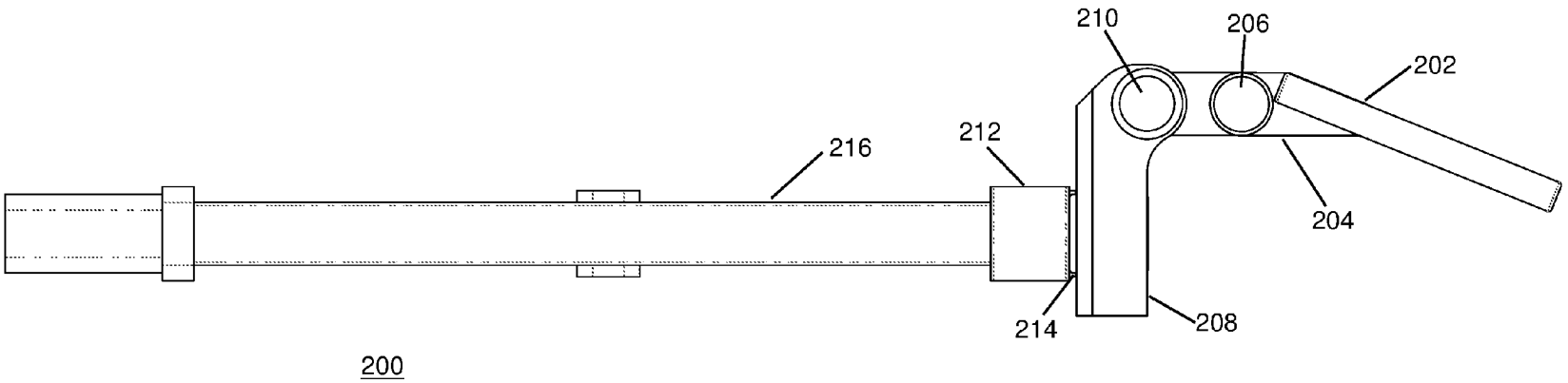
FIG. 2 is a view of the upper surface of a rod bending tool consistent with certain embodiments of the present invention.

Turning now to FIG. 2, this figure presents a view of the upper surface of a rod bending tool 200 consistent with certain embodiments of the present invention. In an exemplary embodiment, the rod bending tool 200 may consist of a bending handle 202 permanently bonded to a flat lever 204. A bend shaft 206 is connected to the flat lever 204 and forms a holding and bending point for metal bending stock on the flat lever 204. The flat lever 204, bending handle 204 and bend shaft 206 form the movable portion of the rid bending tool 200. The base plate 208 is connected to the flat lever 204 at a pivot shaft 210. The pivot shaft 210 forms an interconnection point with the flat lever 204 such that when a user applies force to the flat lever 204 by grasping and either pushing or pulling the bending handle 202, the pivot shaft 210 permits the flat lever 204 to move in a horizontal plane with respect to the base plate 208. The pivot shaft 210 permits the flat lever 204 to traverse approximately 270 degrees of angle with respect to the base plate 210.

In this exemplary embodiment, when in operation, a metal stock rod may be inserted between the pivot shaft 210 and the bend shaft 206. In this embodiment, the bend shaft 206 may act as the fulcrum around which the rod stock material is bent to the desired shape or angle. The flat lever 204, upon which the bend shaft is installed, may be opened or closed to any desired angle, again with relation to the base plate 210, to permit the required initial position for insertion of the rod stock to be manipulated. The user may then apply force to the bending handle 202, either pushing or pulling the bending handle 202, while the rod stock is held in place by the base plate 208. The pivot shaft 210 and bend shaft 206 form the bending points for the rod stock inserted in to the tool, permitting a user to form bends in the inserted rod stock as desired to meet the needs of a construction project on site.

In this exemplary embodiment, the rod bending tool 200 assembly may be connected to an optional mounting adapter 212. The mounting adapter is attached to the rear side of a mounting tube 214. The mounting adapter 212 may be attached to an external mounting tube 216, which may be connected to support apparatuses such as a stand-alone frame, a vehicle, or a trailer hitch associated with a vehicle. The external mounting tube 214 is attached to a support apparatus to permit the rod bending tool 200 to be placed in a vertical position and at a vertical height that is most comfortable for the user, minimizing strain and injuries from the use of the rod bending tool 200.

Figure 3:
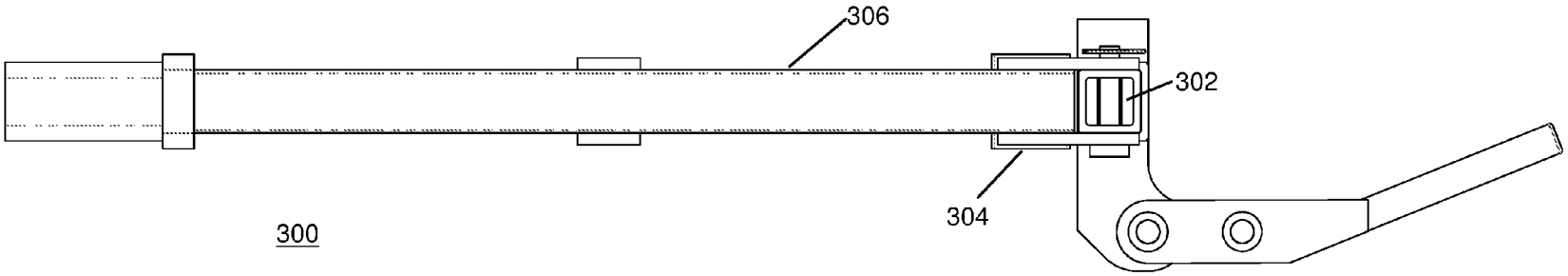
FIG. 3 is a view of the underside of a rod bending tool consistent with certain embodiments of the present invention.

Turning now to FIG. 3, this figure presents a view of the underside of a rod bending tool 300 consistent with certain embodiments of the present invention. In an exemplary embodiment, the optional mounting tube 302 is depicted being attached to the back side of the mounting tube 304. The mounting tube 304 is of sufficient dimension to permit the rod bending tool 300 to be slideably attached to the mounting adaptor 306. The mounting adaptor 306 may have multiple attachment points and vertical positions to permit the rod bending tool to be attached to the mounting adaptor 306 in any of a multitude of positions prior to use of the rod bending tool.

Figure 4:
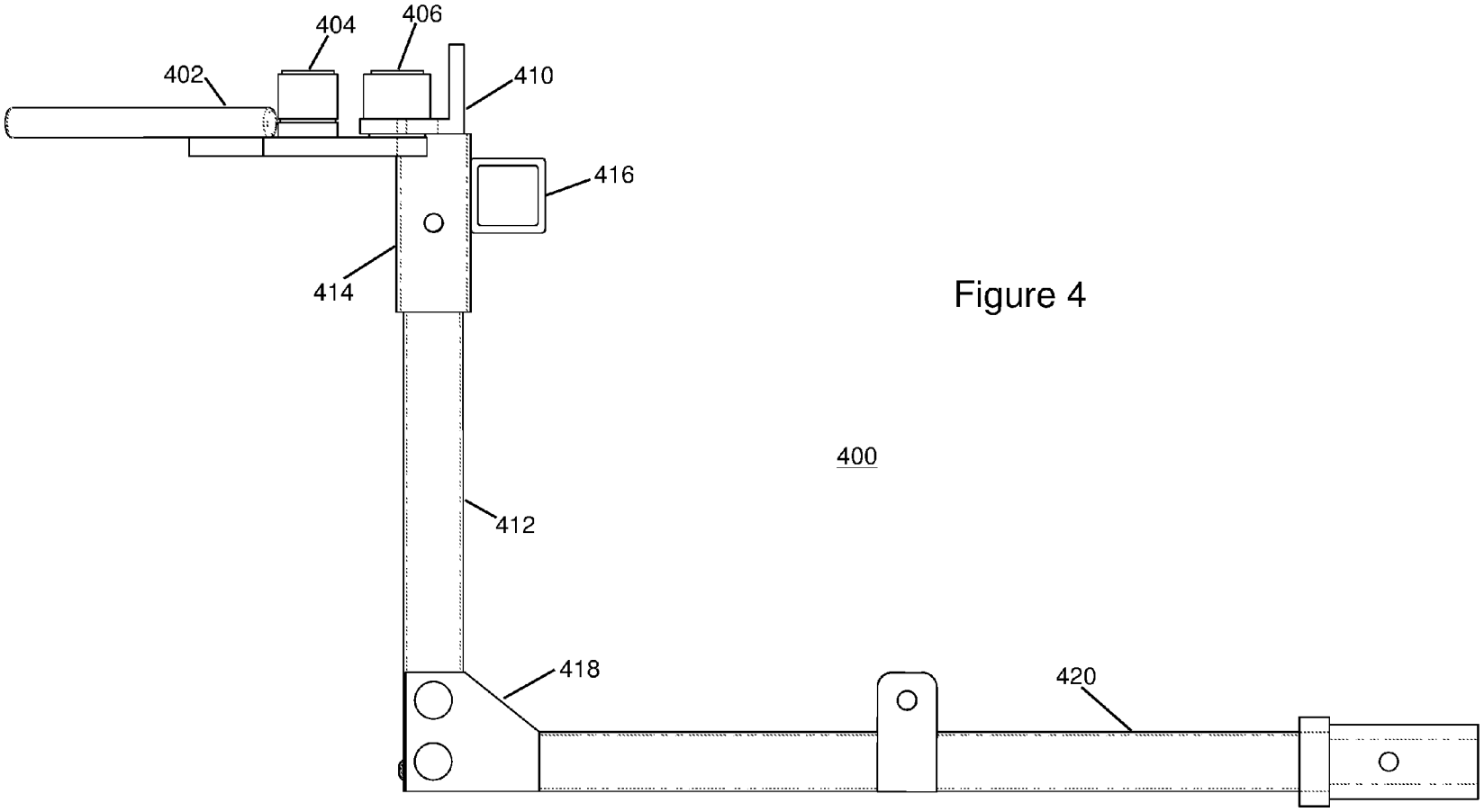
FIG. 4 is a right side view of a rod bending tool consistent with certain embodiments of the present invention.

Turning now to FIG. 4, this figure presents a view of right side view of a rod bending tool 400 consistent with certain embodiments of the present invention. In an exemplary embodiment, it is clear that the proximate and distal ends of the bending handle 402 are rounded to prevent a user from coming to harm from inadvertently grasping one end or the other. The bend shaft 404 and pivot shaft 406 may be aligned in any position along the arc of travel of the flat lever 408 to facilitate both the insertion of and bending of rod stock. The base plate vertical section 410 forms a wall for the leverage in bending operations, and for retention of rod stock between the pivot shaft 406 and the base plate vertical section 410.

In this exemplary embodiment, the rod bending tool 400 may be positioned in a vertical orientation or horizontal orientation to the ground through the use of the mounting adaptor 412. In an exemplary embodiment, a horizontal mounting collar 414 may be slideably connected to the mounting adaptor 412 to permit the insertion of rod stock in a vertical orientation to the ground. In an alternative embodiment, a vertical mounting collar 416 permits a connection to the mounting adaptor 412 that permits the insertion of rod stock in a horizontal orientation to the ground.

In this exemplary embodiment, the mounting adaptor 412 is connected through a 90 degree join 418 to a horizontal support element 420. The horizontal support element 420 is of sufficient length and made of sufficient strength material to permit the attachment to a frame, vehicle, or trailer hitch associated with a vehicle, permitting the transportation and use of the rod bending tool 400 at construction and other sites remotely located from a shop or rod stock manufacturer.

Figure 5:
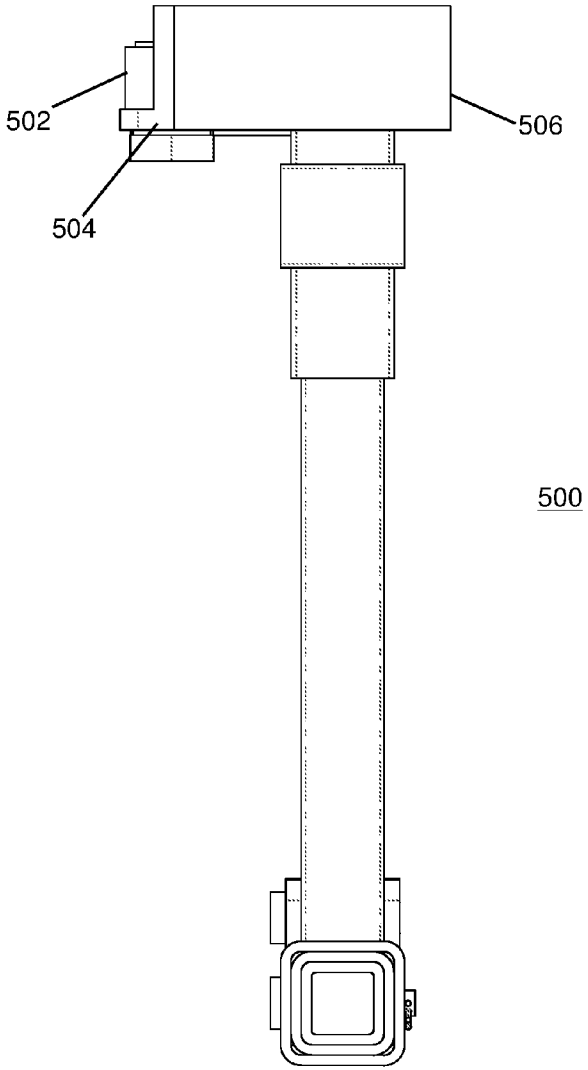
FIG. 5 is a view of the back side of a rod bending tool consistent with certain embodiments of the present invention.

Turning now to FIG. 5, this figure presents a view of the back side of a rod bending tool consistent with certain embodiments of the present invention. In an exemplary embodiment, the rod bending tool 500 may have a pivot shaft 502 having a non-circular shape. The pivot shaft 502 may have a rounded tear drop shape with the narrow section placed so as to permit the narrow section to face the bend shaft (not visible) when the rod bending tool 500 is in operation. The proximate end of the base plate 504 may also be cut off at an angle with relation to the base plate 506 to permit a greater degree of movement of the flat lever portion with relation to the base plate 506 when rod stock has been inserted into the rod bending tool 500. The rounded tear drop shape of the pivot shaft 502 also may permit greater flexibility in the angles of bends and types of bends that can be performed by the tool when in operation.

Figure 6:
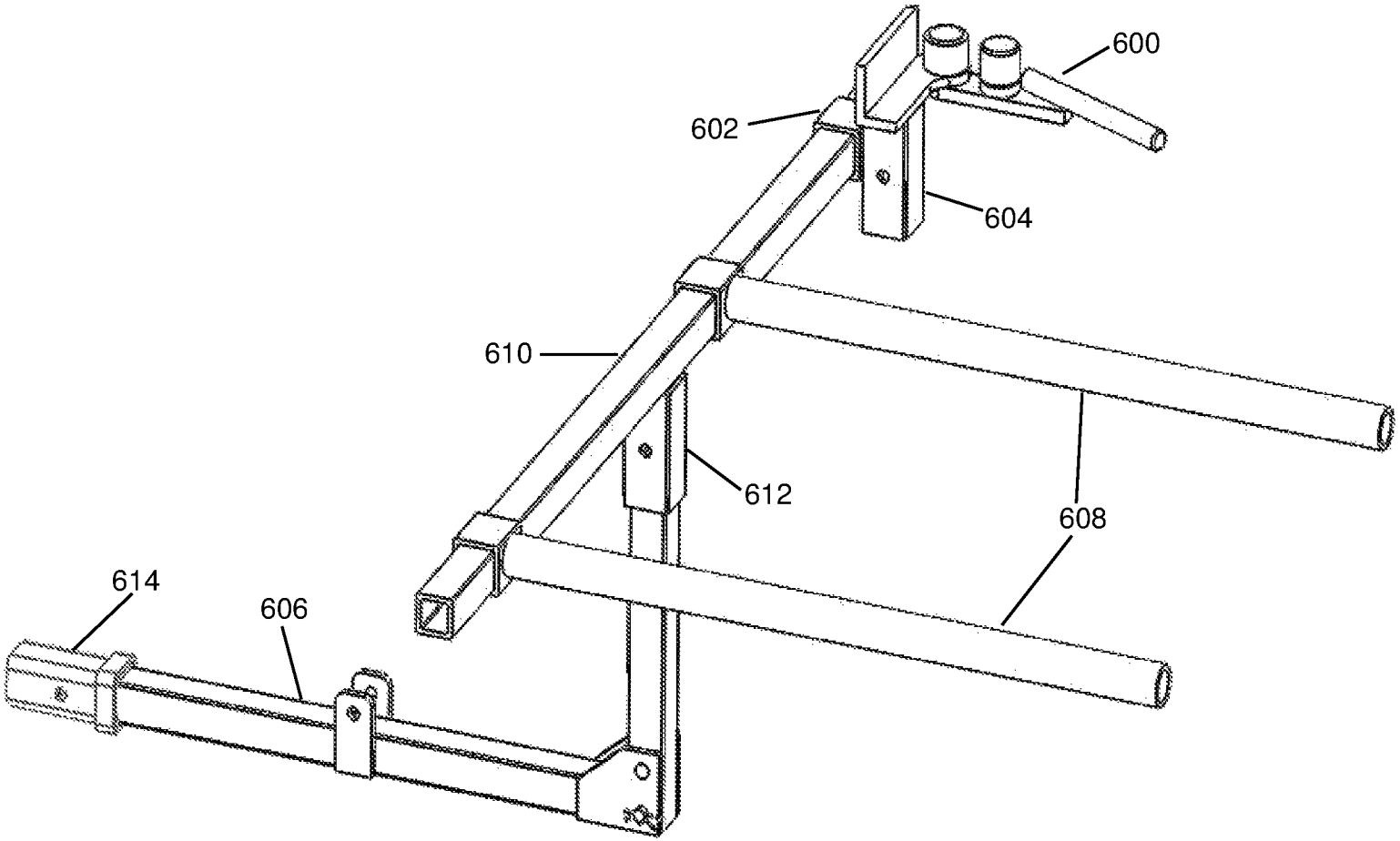
FIG. 6 is a view of a view of a rod bending tool attached to a mounting adaptor in operational configuration consistent with certain embodiments of the present invention.

Turning now to FIG. 6, this figure presents a view of a rod bending tool attached to a mounting adaptor in operational configuration consistent with certain embodiments of the present invention. In this exemplary embodiment, the rod bending tool 600 may have horizontal mounting tube 602 and vertical mounting tube 604 portions permanently attached to the rod bending tool 600. The horizontal mounting tube 602 and the vertical mounting tube 604 are attached in a perpendicular orientation to one another. This attachment permits the rod bending tool 600 to be slideably attached to the mounting adaptor in an orientation that permits either a vertical orientation or a horizontal orientation for rod stock being inserted into the rod bending tool 600. This flexibility of orientation permits a user to adjust the rod bending tool 600 to carry out bends in rod stock that require orientations different than simply horizontal.

In this exemplary embodiment, the mounting adaptor 606 may have one or more adjustable horses arms 608 that permit the support of rod stock as it is undergoing bending operations. The adjustable horses 610 are removably attached to the mounting adaptor 606 through the use of an adjustable horses mounting tube 612. In this embodiment, the mounting adaptor 606 may be attached to a vehicle, frame, or trailer hitch for use in the field. Additionally, the mounting adapter 606 is collapsible and may be folded for easy storage and transport.

Figures 7A, 7B, 7C:
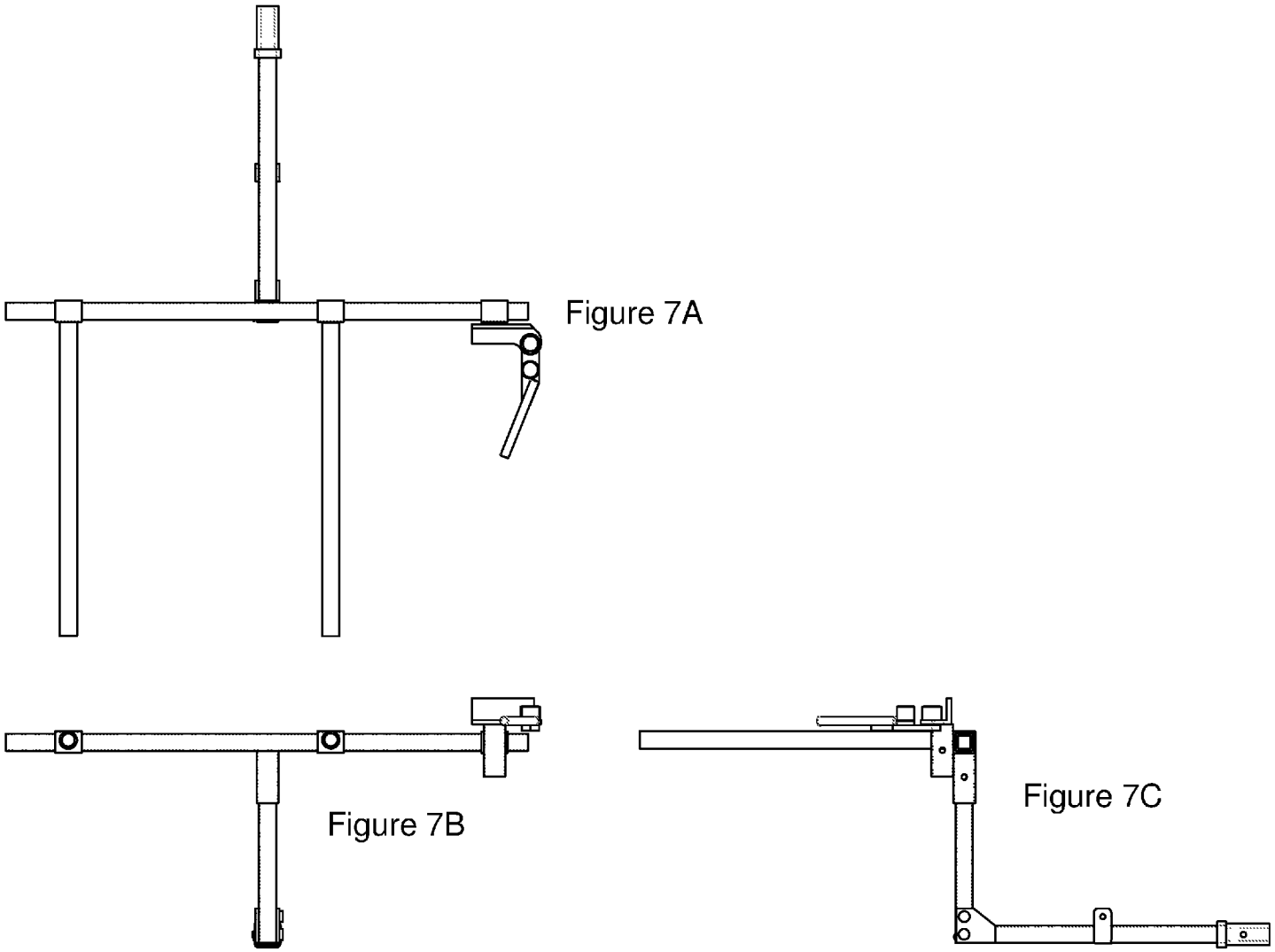
FIG. 7A is a view of a view of a rod bending tool attached to a mounting adaptor in a horizontal operational configuration consistent with certain embodiments of the present invention.
FIG. 7B is a view of a view of a rod bending tool attached to a mounting adaptor in a vertical operational configuration consistent with certain embodiments of the present invention.
FIG. 7C is a view of a view of a rod bending tool attached to a mounting adaptor in a center position operational configuration consistent with certain embodiments of the present invention.

FIG. 7A is a view of a view of a rod bending tool attached to a mounting adaptor in a horizontal operational configuration consistent with certain embodiments of the present invention. In this exemplary embodiment, the rod bending tool is removably attached to an end of the mounting adaptor. The mounting adaptor is a hollow collar that permits the rod bending tool to be slid onto the end of the mounting adaptor in an orientation that places the bend and pivot shafts and the bending handle in a horizontal orientation to the ground at a construction site. This permits a user to insert a section of rod stock to be bent into the rod bending tool in the horizontal plane and permits the user to apply force in the horizontal plane to effect bends required. In this orientation, the rod stock may be supported by the adjustable horse arms as the bending operation is performed, permitting a single user to perform bending actions on very long sections of rod stock without assistance. The horizontal orientation permits the user to stand upright and pull or push toward or away from the center of the user's mass to apply force, reducing strain and injury to the user from repetitive bending actions.

FIG. 7B is a view of a view of a rod bending tool attached to a mounting adaptor in a vertical operational configuration consistent with certain embodiments of the present invention. In this exemplary embodiment, the rod bending tool is removably attached to an end of the mounting adaptor. The mounting adaptor is a hollow collar that permits the rod bending tool to be slid onto the end of the mounting adaptor in an orientation that places the bend and pivot shafts and the bending handle in a vertical orientation to the ground at a construction site. This permits a user to insert a section of rod stock to be bent into the rod bending tool in the vertical plane and permits the user to apply force in the vertical plane to effect bends required. The vertical orientation permits the user to stand upright and pull or push toward or away from the center of the user's mass to apply force, reducing strain and injury to the user from repetitive bending actions.

FIG. 7C is a view of a view of a rod bending tool attached to a mounting adaptor in a center position operational configuration consistent with certain embodiments of the present invention. In this exemplary embodiment, the rod bending tool is removably attached to a middle portion of the mounting adaptor. The mounting adaptor is a hollow collar that permits the rod bending tool to be slid onto the end of the mounting adaptor in an orientation that places the bend and pivot shafts and the bending handle in a horizontal orientation to the ground at a construction site. This permits a user to insert a section of rod stock to be bent into the rod bending tool in the horizontal plane and permits the user to apply force in the horizontal plane to effect bends required. In this orientation and position, the adjustable horse arms may be positioned closer to or further away from the rod bending tool to permit support for the rod stock on either side of the rod bending tool during bending operations. The horizontal orientation permits the user to stand upright and pull or push toward or away from the center of the user's mass to apply force, reducing strain and injury to the user from repetitive bending actions.

While certain illustrative embodiments have been described, it is evident that many alternatives, modifications, permutations and variations will become apparent to those skilled in the art in light of the foregoing description.

What is claimed is:

1. An apparatus for bending rod stock, comprising:

a channel portion for the insertion and support of a portion of rod stock, where the channel portion further comprises a pivot shaft at the proximate end of the channel portion;

a flat lever and base plate connected to the channel portion at the pivot shaft such that the pivot shaft permits the flat lever to traverse approximately 270 degrees of angle with respect to the base plate;

the flat lever further comprising a bend shaft extending upward from an upper surface of the flat lever;

a mounting collar permanently attached to the channel portion and positioned to permit the mounting collar to be removably attached to a mounting element;

the channel portion and flat lever aligned such that the flat lever may pivot with respect to the channel portion when force is applied to the flat lever;

where attaching the mounting collar to the mounting element places the vertical section of the channel portion and the mounting collar in a parallel orientation to the mounting element.

2. The apparatus of claim 1, further comprising a handle permanently attached to the upper surface of the flat lever and positioned at an end opposite to the pivot shaft.

3. The apparatus of claim 1, where the channel portion comprises a horizontal section and a vertical section disposed at a 90 degree angle and permanently connected along the length of the horizontal section and the vertical section.

4. The apparatus of claim 1, where the bend shaft is repositioned with respect to the pivot shaft when force is applied to the flat lever, permitting a portion of rod stock placed between the pivot shaft and the bend shaft to be bent.

5. The apparatus of claim 1, where rod stock may comprise rebar, square stock, flat stock, or any other metal stock or non-metal stock that may be inserted into the channel portion of the apparatus.

6. The apparatus of claim 1, where the mounting element permits the mounting collar to be attached so as to place the channel portion in a horizontal orientation with respect to the ground.

7. The apparatus of claim 1, where the mounting element permits the mounting collar to be attached so as to place the channel portion in a vertical orientation with respect to the ground.

8. The apparatus of claim 1, where the mounting element may be attached to a vehicle, to a trailer hitch, or may comprise a portable freestanding mount structure.

* * * * *